US008430487B2

(12) United States Patent
Sekino

(10) Patent No.: US 8,430,487 B2
(45) Date of Patent: Apr. 30, 2013

(54) INKJET RECORDING APPARATUS

(75) Inventor: Takeshi Sekino, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/948,451

(22) Filed: Nov. 17, 2010

(65) Prior Publication Data

US 2011/0148983 A1 Jun. 23, 2011

(30) Foreign Application Priority Data

Dec. 17, 2009 (JP) ..... 2009-286226

(51) Int. Cl.
*B41J 2/165* (2006.01)

(52) U.S. Cl.
USPC ..... 347/86

(58) Field of Classification Search ..... None
See application file for complete search history.

(56) References Cited

U.S. PATENT DOCUMENTS 6,250,750 B1 * 6/2001 Miyazawa et al. ..... 347/87
6,367,918 B1 * 4/2002 Heiles et al. ..... 347/86

FOREIGN PATENT DOCUMENTS

CN 1526560 A 9/2004
CN 1990240 A 7/2007
JP 2003-200595 A 7/2005

* cited by examiner

*Primary Examiner* — Matthew Luu
*Assistant Examiner* — Alejandro Valencia
(74) *Attorney, Agent, or Firm* — Canon USA Inc IP Division

(57) ABSTRACT

An inkjet recording apparatus includes a joint portion movable to a first position at which communication is established between a flexible tube connected to an ink tank and a recording head and a second position at which such communication is interrupted, a manipulating member rotatably provided on a carriage to take a first posture and a second posture with respect to the carriage, and a link mechanism that causes the manipulating member and the joint portion to operate in conjunction with each other such that the joint portion moves to either of the first position and the second position along with rotation of the manipulating member. The manipulating member is urged to be maintained in either of the first posture and the second posture by a restoration force of the tube.

20 Claims, 9 Drawing Sheets

INKJET RECORDING APPARATUS

BACKGROUND OF THE INVENTION

1. Field of the Invention

The present invention relates to an inkjet apparatus including a tube for supplying ink from an ink tank to a recording head.

2. Description of the Related Art

An inkjet printing apparatus including a tube (supply tube) for supplying ink in an ink tank to a recording head is known in the art. In such an apparatus, it is necessary to separately perform manipulation for fixing the recording head to a carriage and manipulation for connecting the recording head and the supply tube to each other. That is, an operator (user) must perform a plurality of manipulations. In addition, connection between the recording head and the supply tube may be defective depending on the manipulation procedure, which may result in leakage of the ink and intrusion of air into the supply tube.

Japanese Patent Laid-Open No. 2003-200595 discloses an inkjet printer including a unit that completes fixing a recording head in position and connecting a supply tube to the recording head in conjunction with a single operation for closing a manipulating member such as a carriage cover.

In the apparatus disclosed in Japanese Patent Laid-Open No. 2003-200595, when the recording head is to be taken out of a carriage, the carriage cover is rotated to open in order to decouple a joint portion at which the recording head and the supply tube are connected. In this event, the supply tube jointed is also rotated in conjunction with the cover, which pushes the tube to be bent in a direction away from the carriage. At this time, the supply tube bent in a direction away from the carriage is subjected to an extra stress, and a force (restoration force) for restoring the original shape of the tube is generated by the elasticity of the tube itself. This results in a force (reaction force) that acts in a direction opposite the direction of opening the carriage cover, which may make it difficult to hold the cover open and take out the recording head.

SUMMARY OF THE INVENTION

The present invention provides an inkjet recording apparatus in which a recording head and a supply tube are connected to or disconnected from each other in conjunction with a rotating operation of a manipulating member and in which the manipulating member is held at a predetermined rotational position to facilitate attachment and detachment of the recording head.

The present invention also provides an inkjet recording apparatus including: a carriage that removably carries a recording head and that is reciprocally movable with respect to a sheet material; a flexible tube that forms an ink passage from an ink tank to the recording head and that follows the reciprocal movement of the carriage; a manipulating member rotatably disposed on the carriage and capable of taking at least a first posture and a second posture with respect to the carriage; a joint portion disposed on the carriage and movable to a first position at which communication is established between the tube and the recording head and a second position at which such communication is interrupted; and a link mechanism that causes the manipulating member and the joint portion to operate in conjunction with each other such that the joint portion moves from the first position to the second position when the manipulating member is manipulated to rotate from the first posture to the second posture, and the joint portion moves from the second position to the first position when the manipulating member is manipulated to rotate from the second posture to the first posture, in which the manipulating member is urged to be maintained in the first posture or the second posture by a restoration force of the tube.

Further features of the present invention will become apparent from the following description of exemplary embodiments with reference to the attached drawings.

DESCRIPTION OF THE EMBODIMENTS

Figure 1:
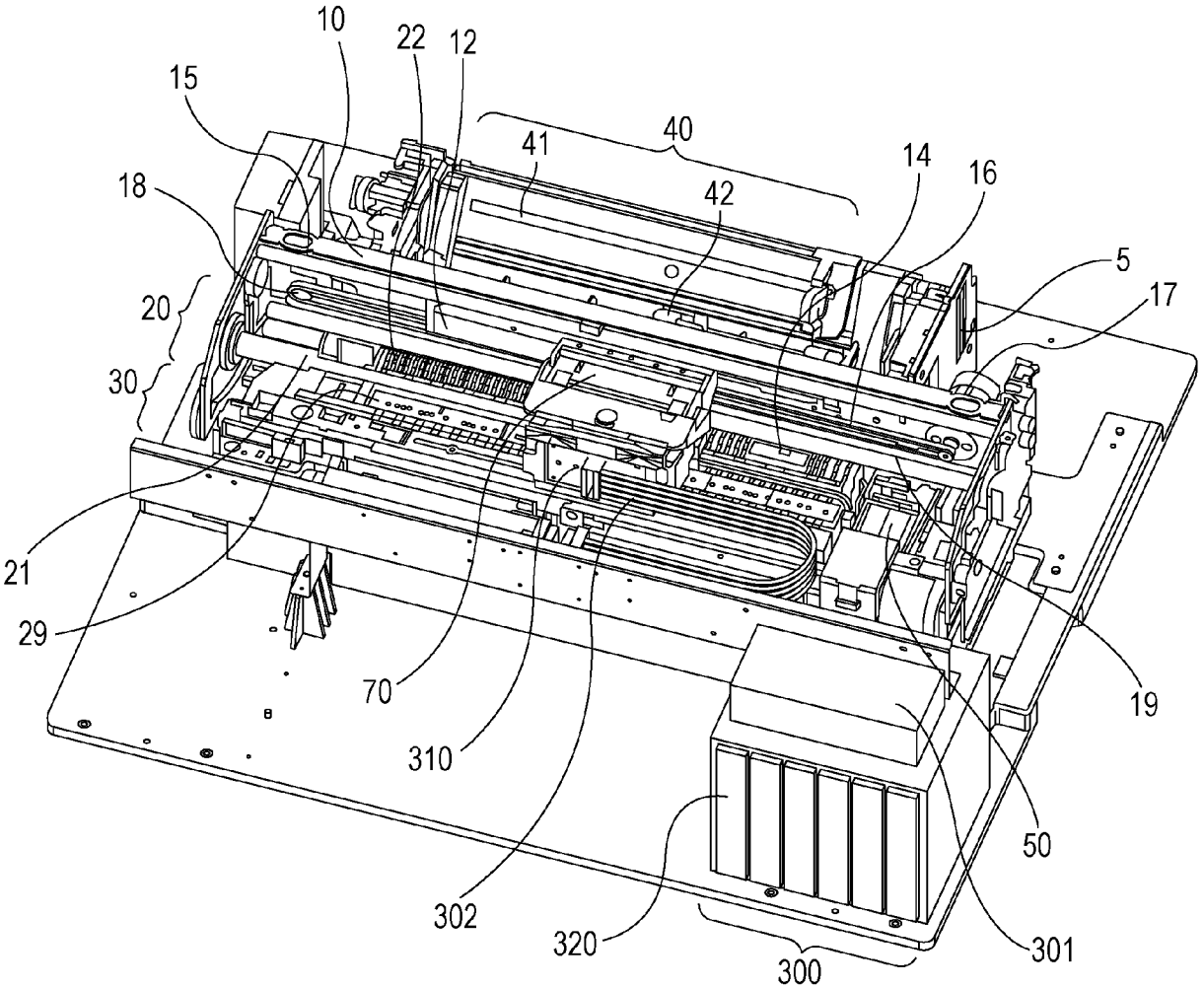
FIG. 1 is a schematic perspective view showing the overall configuration of an inkjet printer according to an embodiment of the present invention.

An exemplary embodiment of the present invention will be described in detail below with reference to FIGS. 1 to 9. Throughout the drawings, identical reference numerals denote identical or corresponding components. In FIGS. 1 to 9, the present invention is applied to an inkjet printer that discharges ink to perform recording on a sheet. The inkjet printer may be of a type that uses a heater element, a type that uses a piezo element, a type that uses an electrostatic element, a type that uses a MEMS element, or the like.

FIG. 1 schematically shows the overall configuration of a printer according to the embodiment. The printing apparatus according to the embodiment is roughly composed of a paper feeding section (ASF unit) 40, a sheet conveying unit 20, a paper ejecting section 30, a carrier unit 70 that carries a recording head 100, and a recording head recovering section (recovery unit) 50. When data to be recorded is sent from a host device (not shown), the data is stored in a printer control section (not shown) on a control substrate 5, and the control section issues a recording operation start command to start a recording operation.

Specifically, a paper feeding operation is first performed. The paper feeding section 40 is an ASF (Automatic Sheet Feeder). The paper feeding section 40 is configured to pull out one sheet, per recording operation, from a plurality of sheets (not shown) placed on a pressure plate 41 using a paper feeding roller 42 to send the sheet to the sheet conveying unit 20.

The sheet delivered from the paper feeding section 40 is conveyed toward nip portions of a conveying roller 21 and a pinch roller 22 forming the sheet conveying unit 20. Thereafter, the driving force for the paper feeding roller 42 is cut off so that the paper feeding roller 42 is rotated as the sheet passes. At this time, the sheet is conveyed by only the conveying roller 21 and the pinch roller 22. The sheet is moved forward by an amount corresponding to a predetermined number of lines at a time, along a rib provided on a platen 29. The leading end of the sheet advances to reach nip portions of a first eject roller (not shown) and a first spur array (not shown). The peripheral speed of the first eject roller (not shown) is generally equal to the peripheral speed of the conveying roller 21. The conveying roller 21 and the first eject roller (not shown) are connected to each other through a gear train. Accordingly, the first eject roller (not shown) rotates in sync with the conveying roller 21 so that the sheet is conveyed without being slackened or stretched.

The carrier unit 70 mainly includes the recording head 100 and a carriage 71 that carries the recording head 100 to scan (move) in a direction crossing (normally perpendicularly) the sheet conveying direction. The carriage 71 is guided and supported by a guide shaft 14 fixed to a chassis 10 and a support rail 15 fixed to an upper portion of the chassis 10. The carriage 71 receives a driving force of a carriage motor 17 via a carriage belt 16 stretched between the carriage motor 17 and an idler pulley 18 to reciprocally move (scan) along the guide shaft 14. A flexible supply tube 302 is connected to the recording head 100 carried by the carriage 71 via a joint portion 310. The supply tube 302 is routed to follow the movement of the carriage 71 over the entire scanning range of the carriage 71 before being connected to a supply unit 300.

Ink tanks (main tanks 320) for various colors are removably mounted to the supply unit 300. The supply unit 300 is provided with a supply pump unit 301 formed by a pump for delivering ink stored in the main tanks 320 to the recording head 100, and so forth. The supply unit 300 is disposed in the vicinity of a paper ejection port provided on the front surface of the apparatus. Therefore, the supply tube 302 extending from the joint portion 310 carried by the carrier unit 70 is routed, as it is bent, to the paper ejection side to be communicated with main passages (not shown) extending from the supply unit 300.

A plurality of ink passages are formed inside the recording head 100. The ink passages are communicated with discharge ports (not shown) disposed in a surface (discharge port surface) facing the platen 29. An ink discharging actuator (energy generating unit) is disposed inside each of the plurality of discharge ports (not shown) forming a discharge port array. Examples of the actuator include an electric thermal conversion member (heater element) such as a heater and an electric mechanical conversion member (electricity-pressure conversion element) such as a piezo element.

According to the configuration described above, the ink stored in the main tanks 320 can be supplied from the supply unit 300 to the inside of the recording head 100 through the supply tube 302 by the supply pump unit 301 even while the carrier unit 70 is scanning.

Figure 3:
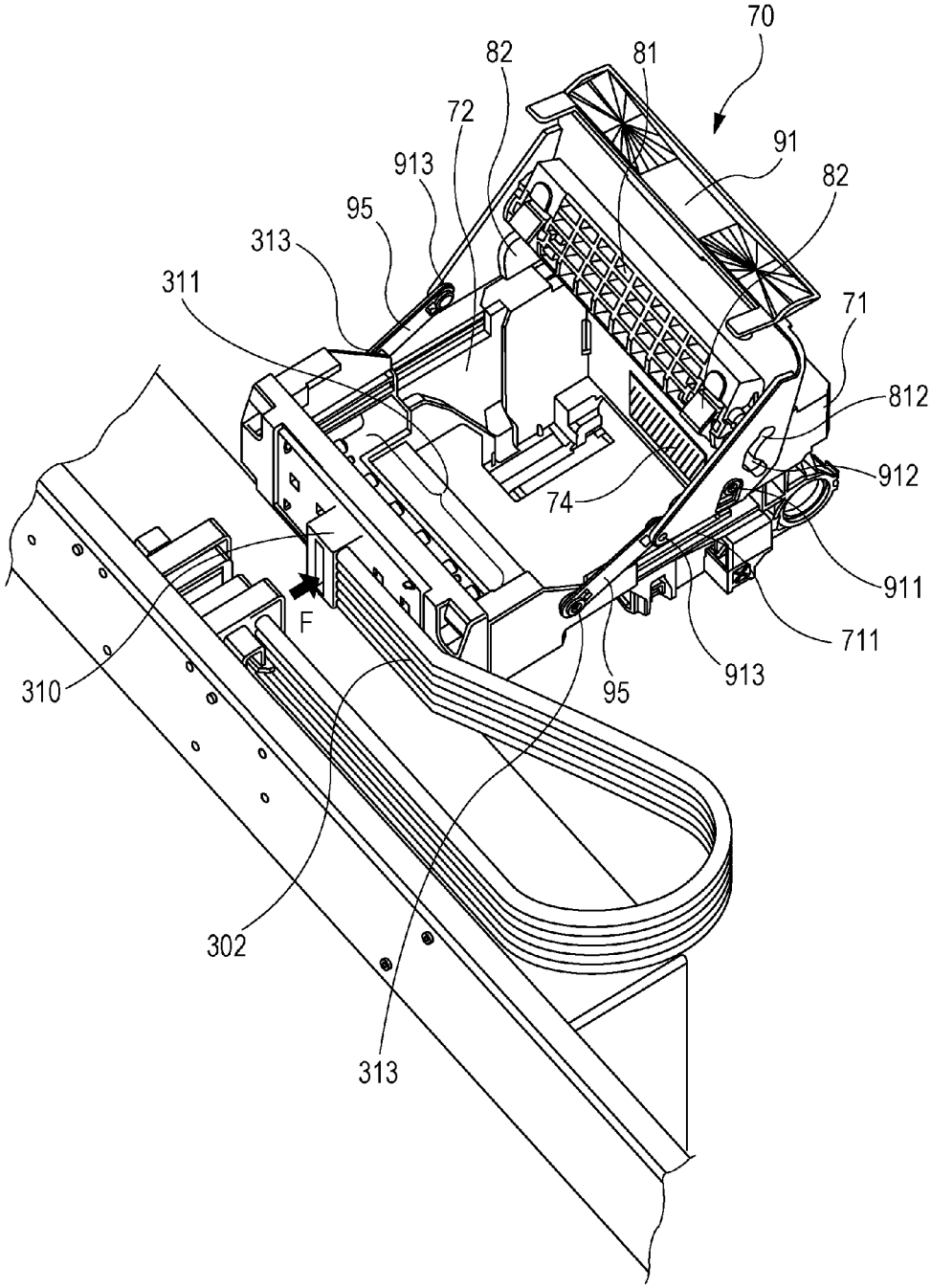
FIG. 3 is a schematic perspective view showing the carrier unit to which the recording head is not mounted and the supply tube connected to the carrier unit.

In order to secure electrical connection between the recording head 100 and the main body of the printer, the recording head 100 is provided with an electric substrate (head substrate) (not shown) having an exposed conductor portion to which a resist is not applied. As shown in FIG. 3, the carriage 71 for carrying the recording head 100 (not shown in FIG. 3) is provided with a press contact connector 74 that is brought into press contact with the exposed conductor portion of the recording head 100 using elastic deformation of a plated metal to be electrically coupled to the exposed conductor portion of the recording head 100.

Further, the press contact connector 74 is soldered to a substrate (carriage substrate) (not shown) carried on the carriage 71. The substrate on the carriage 71 is electrically coupled to the circuit board (control substrate) 5 provided on the main body of the apparatus via a flexible flat cable (FFC) 12.

In the inkjet printer described above, ink droplets can be discharged in accordance with the data to be recorded, by transferring a signal from a head driver (not shown) to the recording head 100 via the FFC 12. In addition, ink droplets can be discharged toward a sheet at appropriate timing by reading a code strip 19 stretched on the chassis 10 using a CR encoder (not shown) carried by the carrier unit 70. When recording is finished for an amount corresponding to one line, the sheet conveying unit 20 conveys (feeds) the sheet by a required amount. By repeatedly performing such operations, a recording operation can be performed over the entire surface of the sheet.

Figure 2:
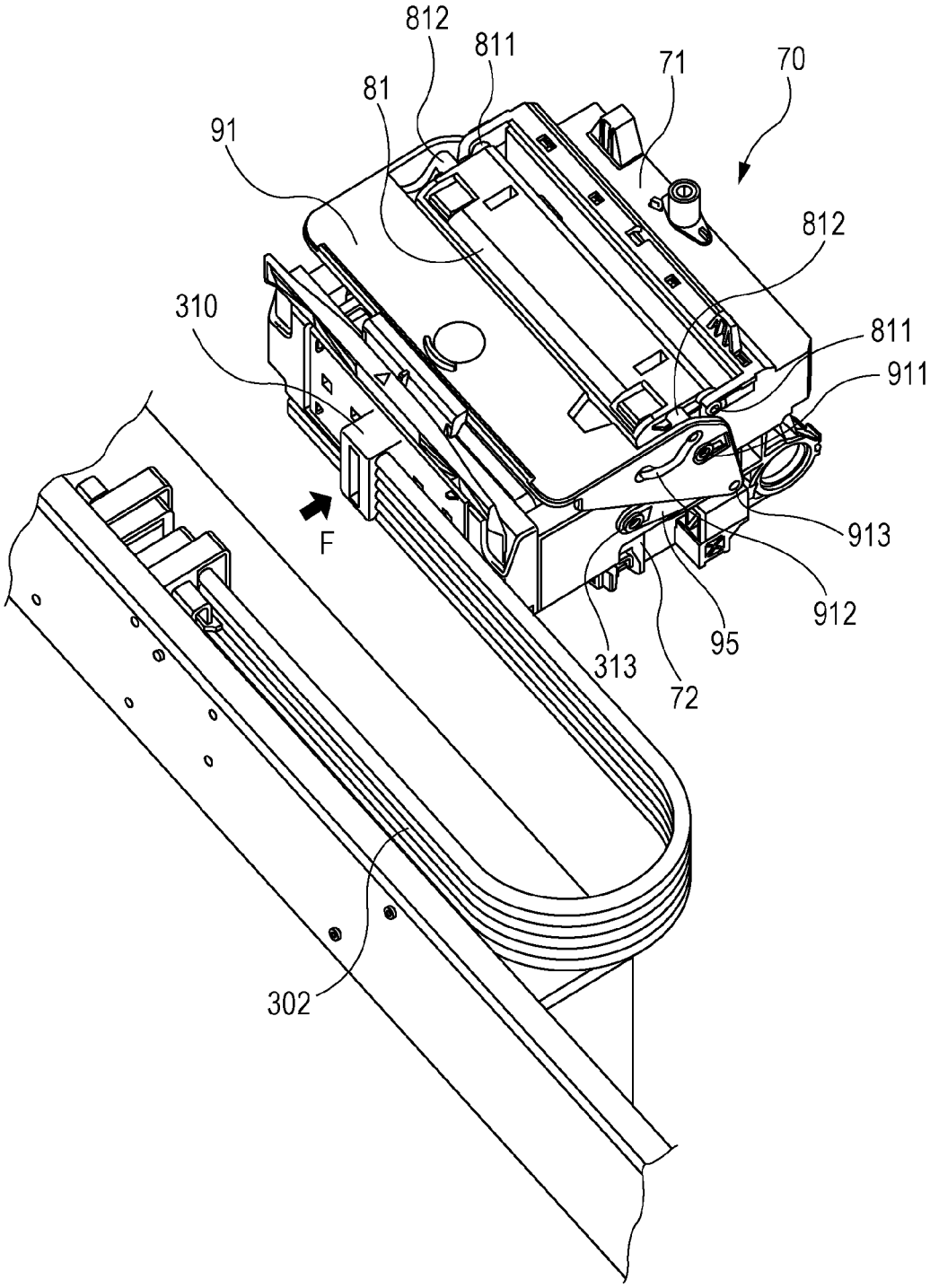
FIG. 2 is a schematic perspective view showing a carrier unit to which a recording head is mounted and a supply tube connected to the carrier unit.

Next, the carrier unit 70 will be described in detail. FIGS. 2 and 3 are each a perspective view of the carrier unit 70 provided in the printer shown in FIG. 1. FIG. 2 shows a state in which the recording head 100 is mounted to the carriage 71.

As shown in FIG. 2, the carrier unit 70 includes a head protection cover 72 that guides the recording head 100 when the recording head 100 is mounted to the carriage 71, and a head fixing mechanism 80 (FIG. 4) that fixes the recording head 100 to the carriage 71. The head fixing mechanism 80 is configured to rotate (swing) with respect to the carriage 71 about a rotation shaft 811 provided on a head fixing lever 81. Bosses 812 are also provided on the head fixing lever 81 to receive a force for opening and closing the head fixing mechanism 80.

The carrier unit 70 is provided with the joint portion 310 that communicates the passages from the supply tube 302 with the passages in the recording head 100. The joint portion 310 is movable to a first position at which it is relatively close to the recording head 100 and a second position at which it is relatively away from the recording head 100. That is, the joint portion 310 can move closer to and away from the recording head 100. When the joint portion 310 moves to the first position, the passages from the supply tube 302 and the passages in the recording head 100 are communicated with each other. When the joint portion 310 moves to the second position, such communication is interrupted.

Further, the printing apparatus is provided with a carriage cover 91 that functions as a manipulating member for a user to apply a force for moving the joint portion 310 closer to and away from the recording head 100 and swinging the head fixing mechanism 80. The carriage cover 91 is attached to the carriage 71 so as to be rotatable about a rotation shaft 911. The carriage cover 91 can be rotated to transition from a first posture in which it is closed to the carriage 71 to a second posture in which it is open to the carriage 71, and vice versa. The carriage cover 91 and the joint portion 310 discussed above are coupled via a link mechanism such that the joint portion 310 moves in conjunction with rotation of the carriage cover 91. Specifically, as shown in FIG. 3, the carriage cover 91 and the joint portion 310 are coupled to each other via a link 95. One end of the link 95 is rotatably coupled to the carriage cover 91 via a first coupling shaft (cover link coupling portion 913), and the other end of the link 95 is rotatably coupled to the joint portion 310 via a second coupling shaft (joint link coupling portion 313). Guide grooves 912 are provided in the carriage cover 91 to guide the bosses 812 of the head fixing lever 81.

The bosses 812 of the head fixing lever 81 discussed above are engaged with the guide grooves 912 of the carriage cover 91. Therefore, the head fixing lever 81 is also swung to make opening and closing operations as the carriage cover 91 is opened and closed. Further, as the carriage cover 91 is opened and closed, the link 95 moves about the cover link coupling portion 913 to move the joint portion 310 coupled to the link 95 via the joint link coupling portion 313.

The supply tube 302 extending from the joint portion 310 carried by the carrier unit 70 is routed, as it is bent, to the paper ejection side to be communicated with the passages from the supply unit 300 (FIG. 1). Thus, a restoration force due to the bending elasticity of the supply tube 302 produced by routing the tube 302 in a bent state is acting in the direction of the arrow F in FIG. 2 at all times.

Figure 4:
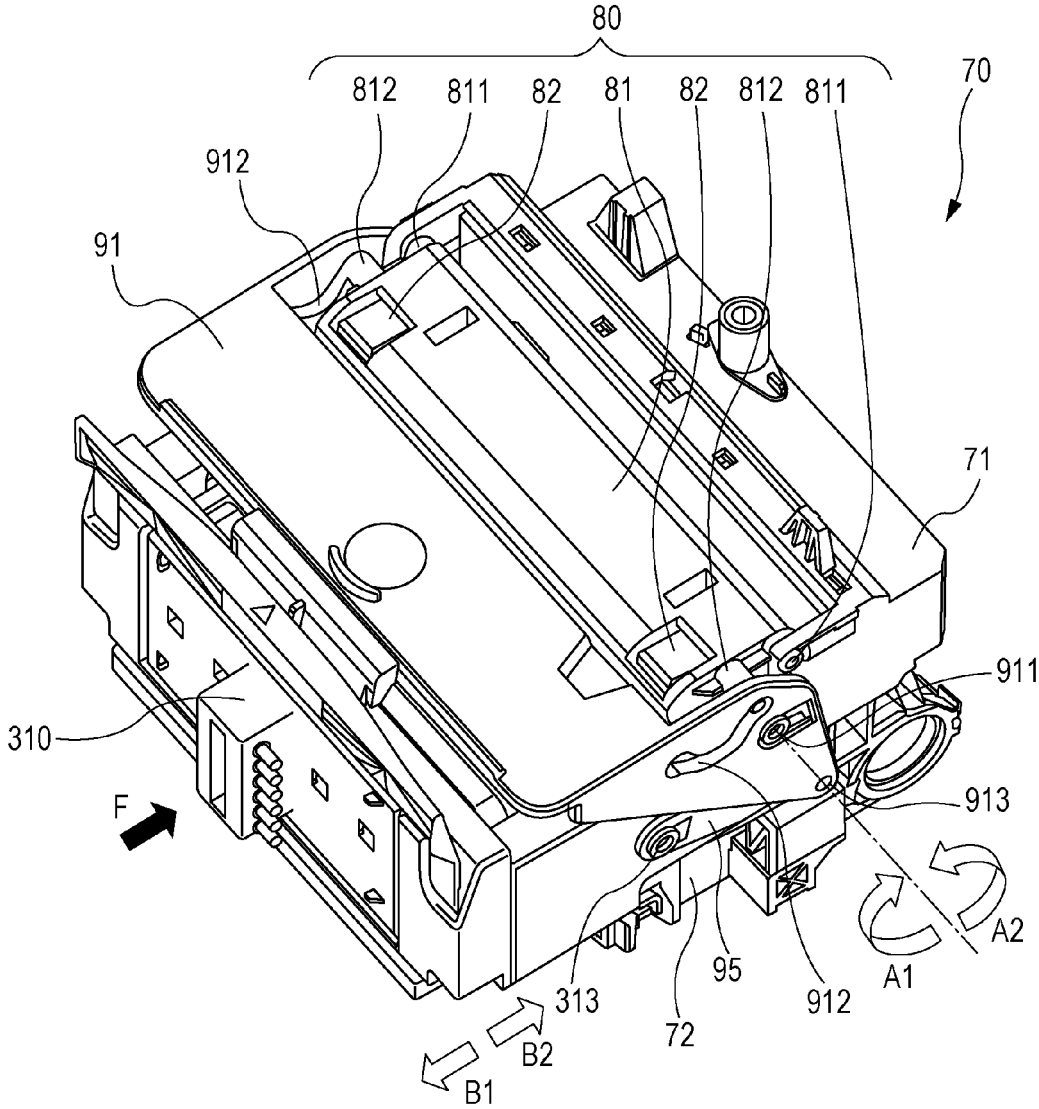
FIG. 4 is a schematic perspective view showing the carrier unit to which the recording head is mounted.

FIG. 3 shows the carrier unit 70 with the recording head 100 removed from the carriage 71 and with the carriage cover 91 and the head fixing mechanism 80 opened. As shown in FIG. 3, head fixing cams 82 pressed by two head fixing springs (not shown) are respectively provided in the vicinity of both ends of the head fixing lever 81 in the extending direction of the rotation shaft 811 (FIG. 4). The head fixing springs (not shown) and the head fixing cams 82 move about the rotation shaft 811 along with the head fixing lever 81 swung in conjunction with opening and closing operations of the carriage cover 91.

Joint needles 311 are provided on the recording head 100 side of the joint portion 310 to establish communication with the passages provided in the recording head 100. Thus, by moving the joint portion 310 closer to and away from the recording head 100, the joint needles 311 are inserted into and extracted from joint insertion ports 102 (FIG. 5) of the recording head 100 to be discussed later, which establishes and blocks communication of the ink passages from the supply unit 300.

When the carriage cover 91 is open and the joint portion 310 is moved in the direction away from the carriage 71 as shown in FIG. 3, the supply tube 302 is pressed inwardly of the bend R compared to when the carriage cover 91 is closed. Thus, as in FIG. 2, a restoration force produced by routing the supply tube 302 in a bent state acts in the direction of the arrow F in FIG. 3.

Figure 5:
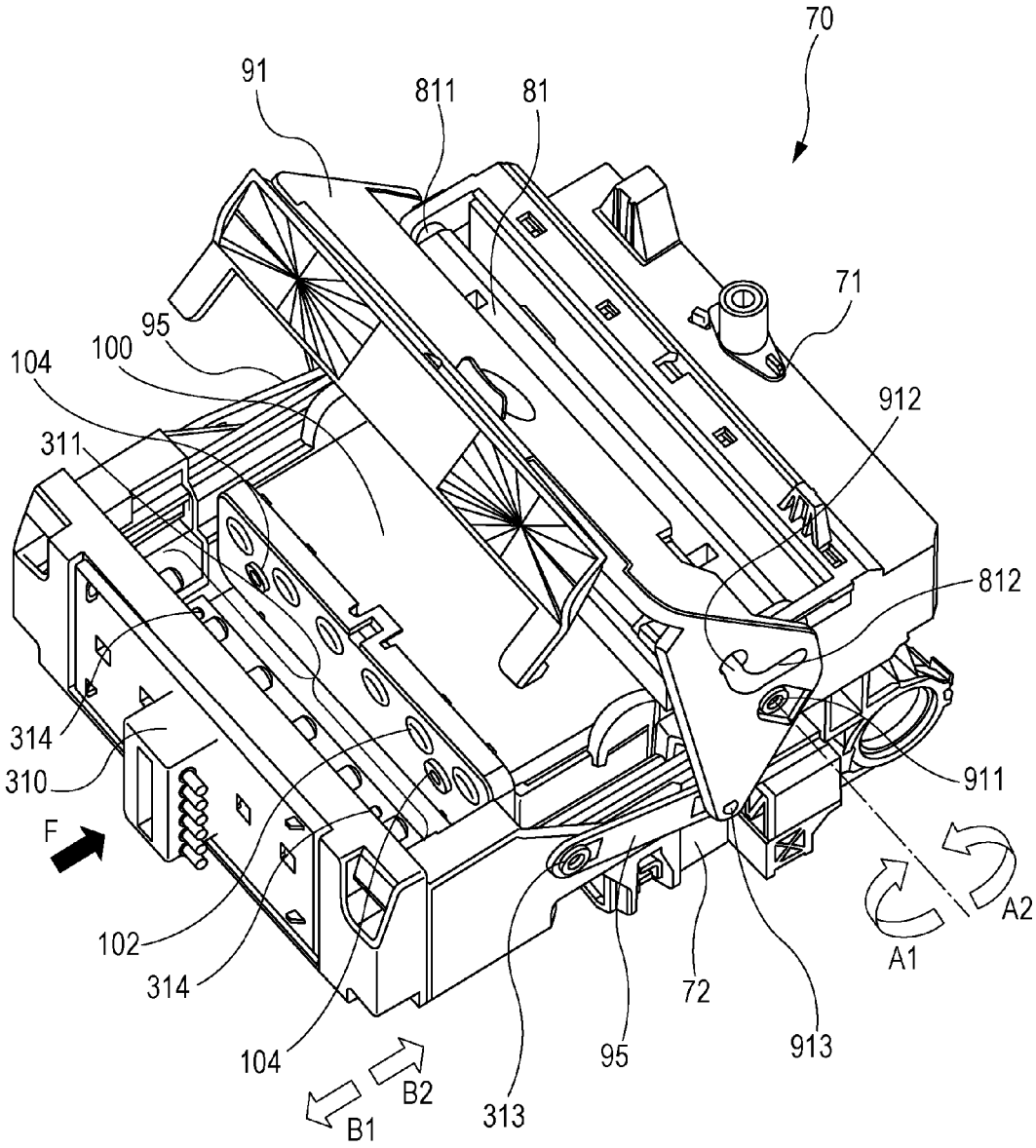
FIG. 5 is a schematic perspective view showing an operation for mounting the recording head to the carrier unit.
Figure 6:
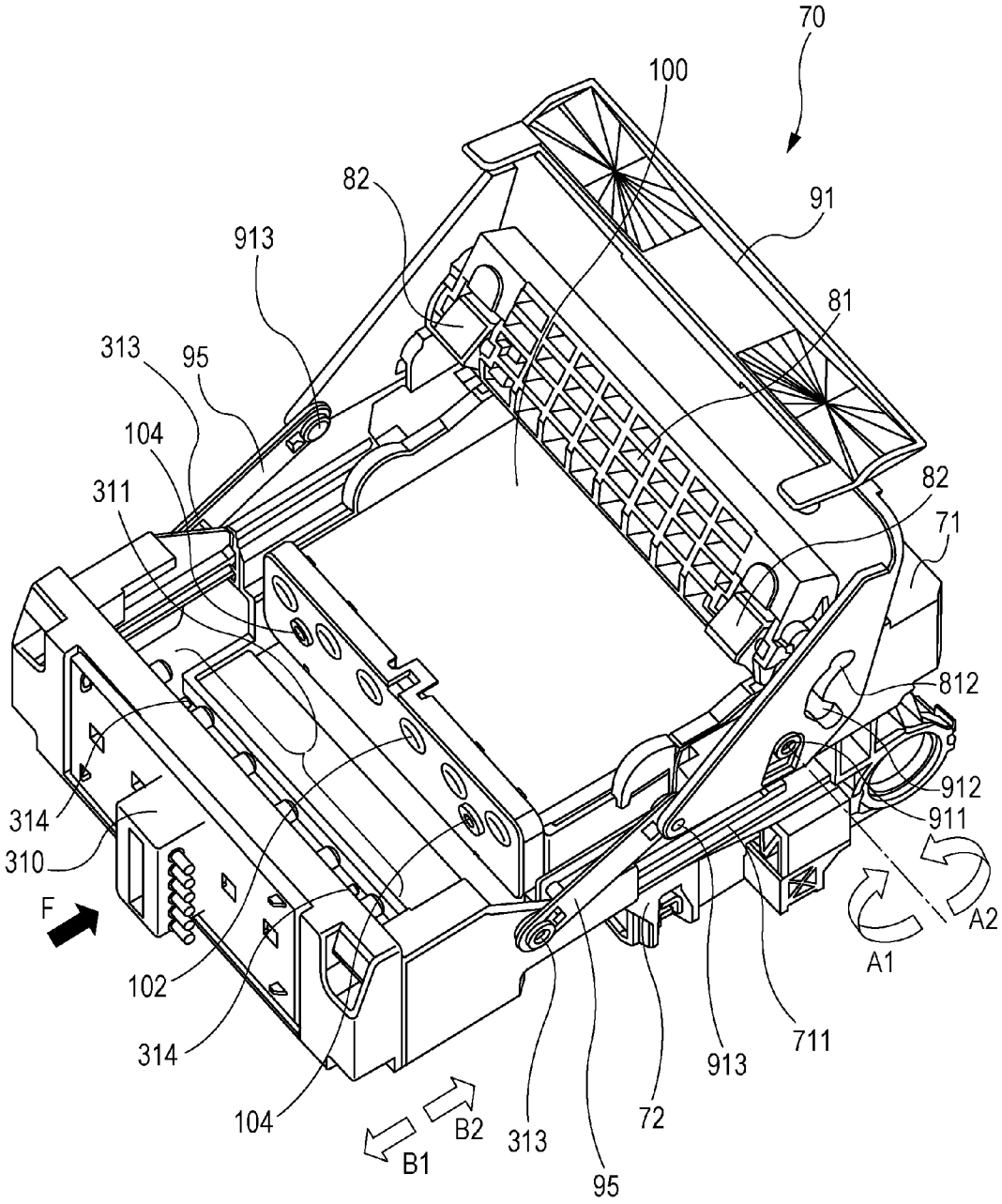
FIG. 6 is a schematic perspective view showing a state in which the recording head is unfixed from the carrier unit.

Next, operations for attaching and detaching the recording head 100 to and from the carriage 71 will be described with reference to FIGS. 4 to 6, which are schematic perspective views of the carriage 71, and FIGS. 7 to 9, which are schematic side views of the carriage 71. In the schematic views of FIGS. 4 and 7, the recording head 100 is mounted to be fixed, and the joint portion 310 is communicably connected (moved to the first position). In the schematic views of FIGS. 5 and 8, the recording head 100 is mounted, and the joint portion 310 is disconnected (moved to the second position). In the schematic views of FIGS. 6 and 9, the recording head 100 is released, and the joint portion 310 is disconnected from the recording head 100. In FIGS. 4 to 6, only the carrier unit 70 is shown schematically, and the supply tube 302 and so forth are not shown. In practice, however, the supply tube 302 and so forth are provided in the same way as in FIGS. 1 to 3 with a restoration force of the supply tube 302 acting in the direction of the arrow F in each drawing.

Operation performed by the user to remove the recording head 100 from the carriage 71 will be described. With the recording head 100 mounted, the carriage cover 91 is manipulated to rotate about the rotation shaft 911 in the direction of the arrow A1 shown in FIGS. 4 and 7. That is, the carriage cover 91 is transitioned from the first posture to the second posture. In this case, the link 95 moves about the cover link coupling portion 913 along with rotation of the carriage cover 91. At this time, the link 95 linearly moves the joint portion 310, which is coupled to the link 95 via the joint link coupling portion 313, in the direction of the arrow B1. That is, the joint portion 310 is moved from the first position toward the second position. The joint portion 310 is guided by guide portions 711 (FIG. 6) provided on the carriage 71 to move linearly in the direction away from the recording head 100 against the restoration force F of the supply tube 302 (FIGS. 5 and 8). Then, the joint needles 311 provided on the joint portion 310 are disconnected from the joint insertion ports 102 provided in the recording head 100 and made of a joint seal rubber to decouple the ink passages (FIGS. 5 and 8).

In the case where the recording head 100 is mounted to be fixed, the joint needles 311 are inserted into the joint insertion ports 102, and sealed by the joint seal rubber to form communicably connected ink passages.

Figure 8:
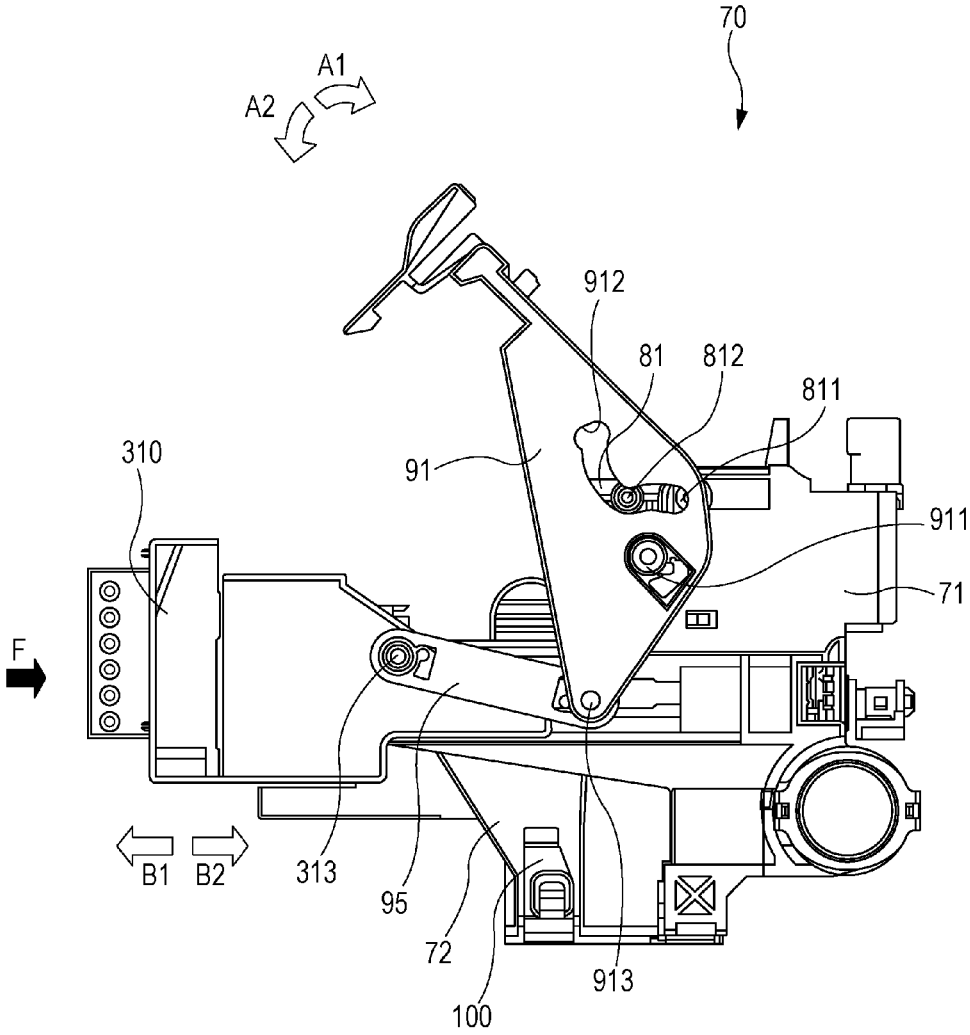
FIG. 8 is a schematic side view showing an operation for mounting the recording head to the carrier unit.

When the carriage cover 91 is further rotated in the direction of the arrow A1 (to take the second posture) from the state shown in FIGS. 5 and 8, the joint portion 310 coupled to the link 95 further moves in the direction of the arrow B1 (toward the second position) in the same as discussed above. At the same time, the manipulating force is transferred to the bosses 812 engaged with the guide grooves 912 provided in the carriage cover 91 so that the head fixing mechanism 80 unfixes the recording head 100 when the manipulating force exceeds the pressing force of the head fixing springs exerted via the head fixing cams 82. Subsequently, the head fixing mechanism 80 is rotated (swung) about the rotation shaft 811 to be open in conjunction with rotation of the carriage cover 91, which brings the carriage cover 91 to a fully open state of FIG. 6. That is, the carriage cover 91 takes the second posture.

Figure 9:
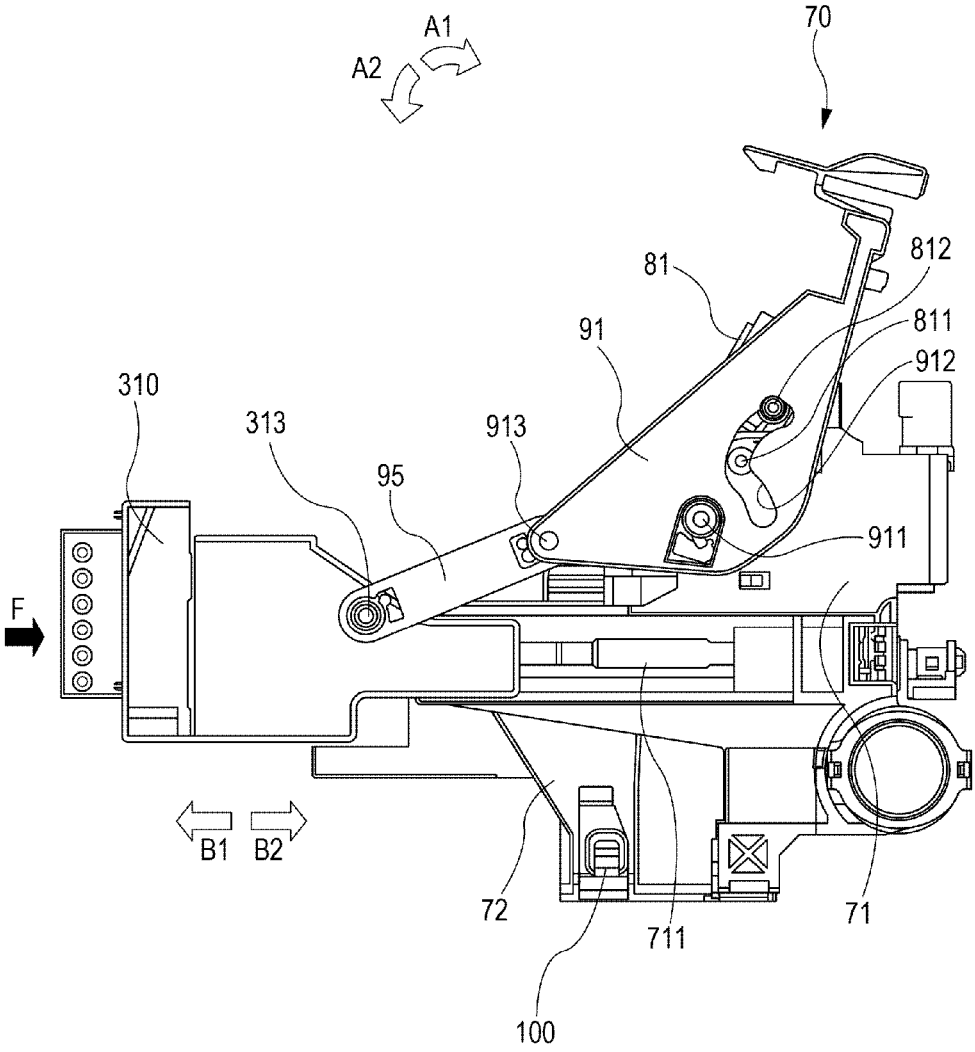
FIG. 9 is a schematic side view showing a state in which the recording head is unfixed from the carrier unit.

As shown in FIG. 9, the cover link coupling portion 913 serving as the first coupling shaft is positioned above the line connecting the rotation shaft 911 of the carriage cover 91 and the joint link coupling portion 313 serving as the second coupling shaft in the vertical direction in the state shown in FIG. 6. Meanwhile, as shown in FIGS. 2 and 3, the joint portion 310 is urged by the restoration force of the supply tube 302 in the direction of the arrow F, that is, in the direction closer to the recording head 100 (arrow B2), irrespective of whether the carriage cover 91 is open or closed. Thus, when the cover link coupling portion 913 is positioned above the above-mentioned line in the vertical direction as shown in FIG. 9, the restoration force of the supply tube 302 urges the carriage cover 91 (cover link coupling portion 913) in the direction of the arrow A1 via the link mechanism. In other words, the link mechanism functions as a toggle mechanism that causes the restoration force of the supply tube 302 to act on the carriage cover 91 which has been manipulated to rotate to the second posture as a force for maintaining the carriage cover 91 in the second posture.

According to the configuration described above, the carriage cover 91 can be stably maintained in the open state (second posture) shown in FIGS. 6 and 9 without providing any special urging member or the like to the carrier unit 70.

When the recording head 100 is to be removed from the carriage 71, as described above, communication between the supply tube 302 (joint portion 310) and the recording head 100 is first interrupted, and thereafter the head fixing mechanism 80 unfixes the recording head 100.

Next, a description will be made of a case where the user mounts the recording head 100 to the carriage 71.

First, the user places the recording head 100 into the carrier unit 70 (FIGS. 6 and 9). Subsequently, the carriage cover 91 is manipulated to rotate about the rotation shaft 911 in the direction of the arrow A1 shown in FIGS. 6 and 9. That is, the carriage cover 91 is transitioned from the second posture to the first posture. Then, the head fixing mechanism 80 swings about the rotation shaft 811 to be closed in conjunction with a closing operation of the carriage cover 91. At this time, the head fixing cams 82 provided on the head fixing mechanism 80 contact the recording head 100 so that the recording head 100 is pressed against the carriage 71 to be fixed in position by the pressing force of the head fixing springs exerted via the head fixing cams 82.

In the same course of time, the link 95 operates along with rotation of the carriage cover 91 so that the joint portion 310 linearly moves in the direction of the arrow B2. That is, the joint portion 310 is moved from the second position toward the first position. The joint portion 310 is guided by the guide portion 711 (FIG. 6) to move closer to the recording head 100, but does not move as much as the joint needles 311 are inserted for connection with the recording head 100 (FIGS. 5 and 8).

When the carriage cover 91 is rotated in the direction of the arrow A2 (to take the first posture) from the state of FIGS. 5 and 8, the joint portion 310 further linearly moves in the direction of the arrow B2. That is, the joint portion 310 moves toward the first position. Then, positioning guide pins 314 provided on the joint portion 310 are inserted into guide holes 104 of the recording head 100 for positioning. Subsequently, the joint needles 311 are inserted into the joint insertion ports 102 formed in the recording head 100. That is, when the recording head 100 is to be mounted to the carriage 71, the head fixing mechanism 80 first fixes the recording head 100, and thereafter the supply tube 302 (joint portion 310) and the recording head 100 are communicated with each other. In other words, the joint needles 311 are inserted after the joint portion 310 is directly positioned with respect to the recording head 100, which enables stable and reliable communication between the passages.

Figure 7:
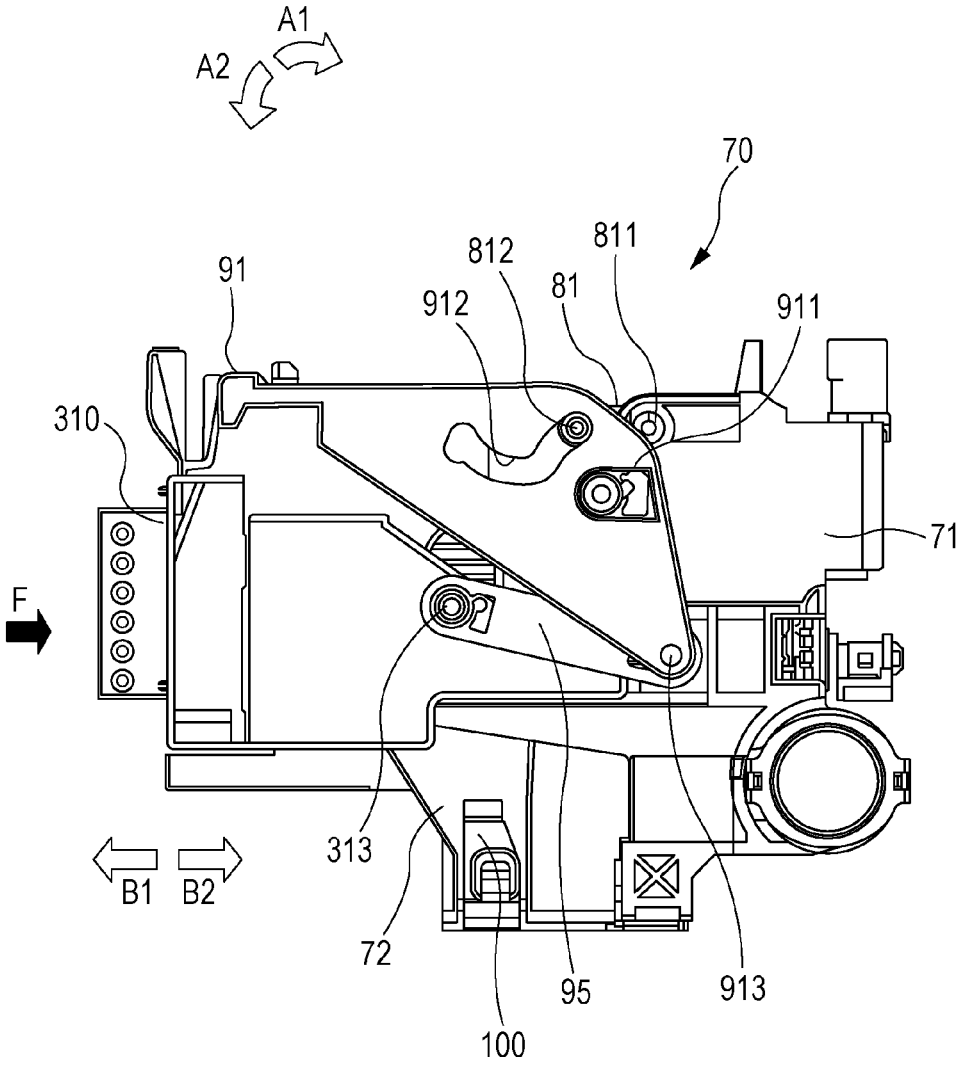
FIG. 7 is a schematic side view showing a state in which the recording head is mounted to the carrier unit.

According to the configuration described above, the user can complete fixing the recording head 100 in position and coupling the joint portion 310 by just performing a manipulation for rotating the carriage cover 91 (FIGS. 4 and 7).

As shown in FIG. 7, the cover link coupling portion 913 serving as the first coupling shaft is positioned below the line connecting the rotation shaft 911 of the carriage cover 91 and the joint link coupling portion 313 serving as the second coupling shaft in the vertical direction in the state shown in FIGS. 7 and 4. Meanwhile, as shown in FIGS. 2 and 3, the joint portion 310 is urged by the restoration force of the supply tube 302 in the direction of the arrow F, that is, in the direction closer to the recording head 100 (arrow B2), irrespective of whether the carriage cover 91 is open or closed. Thus, when the cover link coupling portion 913 is positioned below the above-mentioned line in the vertical direction, the restoration force of the supply tube 302 urges the carriage cover 91 (cover link coupling portion 913) in the direction of the arrow A1 via the link mechanism. In other words, the link mechanism functions as a toggle mechanism that causes the restoration force of the supply tube 302 to act on the carriage cover 91 which has been manipulated to rotate to the first posture as a force for maintaining the carriage cover 91 in the first posture.

According to the configuration described above, the carriage cover 91 can be stably maintained in the closed state (first posture) shown in FIGS. 4 and 7 without providing any special urging member or the like to the carrier unit 70. The link mechanism causes the restoration force of the tube to act on the manipulating member which has been manipulated to rotate to the first posture as a force for maintaining the manipulating member in the first posture, and to act on the manipulating member which has been manipulated to rotate to the second posture as a force for maintaining the manipulating member in the second posture. While the restoration force of the tube may maintain the manipulating member in each of the first posture and the second posture, the link mechanism may also be configured to maintain the manipulating member in at least one of the first posture and the second posture.

According to the inkjet printer of the embodiment described above and shown in FIGS. 1 to 9, the recording head can be mounted to the carriage in a simple, inexpensive, reasonable, and reliable way with nothing in particular to be considered by the user.

While a single recording head is mounted to a carriage in the embodiment, the present invention can be implemented irrespective of the number of recording heads. Specifically, the present invention is similarly applicable not only to inkjet printers with one or more recording heads but also to inkjet printers for color recording with a plurality of recording heads for different color inks to achieve the same effect. The present invention is also similarly applicable to inkjet printers for gradation recording with a plurality of recording heads for inks with the same color but with different densities, and to inkjet printers obtained by combining the above types of inkjet printers, to achieve the same effect. The present invention is additionally applicable to printing apparatuses having a printing function such as copying apparatuses and facsimile apparatuses, and various inkjet apparatuses such as manufacturing apparatuses for manufacturing various devices using an inkjet technology, inspection apparatuses, and spraying apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-286226 filed Dec. 17, 2009, which is hereby incorporated by reference herein in its entirety.

What is claimed is:

1. An inkjet recording apparatus comprising:

a carriage that removably carries a recording head moves along a guide for recording;

a flexible tube that establishes an ink passage from an ink tank to the recording head, the tube following a movement of the carriage for recording;

a manipulating member rotatably disposed on the carriage and taking at least a first posture and a second posture with respect to the carriage;

a joint portion disposed on the carriage and movable to a first position, at which communication for supplying ink to the recording head is established between the tube and the recording head, and a second position, at which the communication is interrupted, the joint portion being closer to the recording head at the first position than when the joint portion is at the second position; and a link mechanism that causes the manipulating member and the joint portion to operate in conjunction with each other such that the joint portion moves from the first position to the second position when the manipulating member is manipulated to rotate from the first posture to the second posture, and the joint portion moves from the second position to the first position when the manipulating member is manipulated to rotate from the second posture to the first posture, wherein a restoration force, produced by the tube and in a direction from the second position toward the first position, is applied to the joint portion such that the manipulating member remains in the second posture when the joint portion is at the second position.

2. An inkjet recording apparatus according to claim 1, wherein the link mechanism causes the restoration force of the tube to act on the manipulating member which has been manipulated to rotate to the first posture as a force for maintaining the manipulating member in the first posture, and to act on the manipulating member which has been manipulated to rotate to the second posture as a force for maintaining the manipulating member in the second posture.

3. An inkjet recording apparatus according to claim 1, wherein the link mechanism has a link, one end of which is rotatably coupled to the manipulating member via a first coupling shaft, and the other end of which is rotatably coupled to the joint portion via a second coupling shaft, and wherein the first coupling shaft is positioned below a line connecting a rotation shaft, coupling the manipulating member and the carriage, and the second coupling shaft in a vertical direction when the manipulating member takes the first posture, and positioned above the line in the vertical direction when the manipulating member takes the second posture.

4. An inkjet recording apparatus according to claim 1, further comprising: a fixing mechanism that fixes the recording head to the carriage and unfixes the recording head from the carriage in conjunction with an operation of the manipulating member.

5. An inkjet recording apparatus according to claim 4, wherein when the manipulating member is transitioned from the first posture to the second posture, the joint portion first starts moving from the first position to the second position, and thereafter the fixing mechanism unfixes the recording head from the carriage.

6. An inkjet recording apparatus according to claim 4, wherein when the manipulating member is transitioned from the second posture to the first posture, the fixing mechanism first fixes the recording head to the carriage, and thereafter the joint portion starts moving from the second position to the first position.

7. An inkjet recording apparatus according to claim 4, wherein the fixing mechanism includes a mechanism rotatably attached to the carriage and engaged with the manipulating member to rotate with respect to the carriage in conjunction with rotation of the manipulating member, the mechanism bringing the recording head into press contact with the carriage for fixation when the manipulating member takes the first posture, and the mechanism being urged by the restoration force of the tube via the manipulating member when the manipulating member takes the second posture.

8. The inkjet recording apparatus according to claim 1, wherein the restoration force is applied to the joint portion such that the manipulating member remains in the first posture when the joint portion is at the first position.

9. An inkjet recording apparatus comprising:

a carriage configured to removably mount a recording head;

a flexible tube configured to supply ink to the recording head;

a joint portion mounted on the carriage and configured to move to a connecting position, where the flexible tube is connected to the recording head for supplying the ink through the joint portion, and to a disconnecting position, where the flexible tube is not connected to the recording head, the joint portion being closer to the recording head at the connecting position than when the joint portion is at the disconnecting position;

a manipulating member configured to move the joint portion to the connecting position by moving to a first position and to move the joint portion to the disconnecting position by moving to a second position; and a linking member configured to link the manipulating member with the joint portion, wherein the tube produces a restoration force in a direction from the disconnecting position toward the connecting position, and the manipulating member is urged, by applying the restoration force to the joint portion, to maintain the first position when the joint portion is at the connecting position and to maintain the second position when the joint portion is at the disconnecting position.

10. The inkjet recording apparatus according to claim 9, further comprising the recording head to be mounted on the carriage.

11. The inkjet recording apparatus according to claim 9, further comprising a fixing mechanism that fixes the recording head to the carriage and unfixes the recording head from the carriage in conjunction with an operation of the manipulating member.

12. The inkjet recording apparatus according to claim 11, wherein, when the manipulating member rotates from the first position to the second position, the joint portion first starts moving from the connecting position to the disconnecting position, and thereafter the fixing mechanism unfixes the recording head from the carriage.

13. The inkjet recording apparatus according to claim 11, wherein, when the manipulating member rotates from the second position to the first position, the fixing mechanism first fixes the recording head to the carriage, and thereafter the joint portion starts moving from the second position to the first position.

14. The inkjet recording apparatus according to claim 11, wherein the fixing mechanism includes a mechanism rotatably attached to the carriage and engaged with the manipulating member to rotate with respect to the carriage in conjunction with rotation of the manipulating member.

15. An inkjet recording apparatus comprising:

a carriage configured to mount a recording head for discharging ink;

a joint portion configured to supply the ink to the recording head, the joint portion moving from a first position to a second position along a guide, the joint portion being closer to the recording head at the first position than when the joint portion is at the second position;

a manipulating member configured to rotate about a rotation shaft from a first posture to a second posture with respect to the carriage, the second posture being a posture for attaching the recording head to the carriage and detaching the recording head from the carriage;

a link configured to link the manipulating member to the joint portion such that rotation of the manipulating member from the first posture to the second posture is associated with movement of the joint portion along the guide from the first position to the second position; and a tube configured to supply the ink to the recording head through the joint portion, the tube being connected to the joint portion in a bent state such that a restoration force of the tube, in a direction from the second position toward the first position, is produced, wherein the restoration force is applied to the joint portion such that the manipulating member is urged to maintain the second posture when the joint portion is at the second position.

16. The recording apparatus according to claim 15, wherein the manipulating member is connected with the link by a first coupling portion, the link is connected with the joint portion by a second coupling portion, and the first coupling portion is positioned above a line connecting the rotation shaft with the second coupling portion in a vertical direction when the manipulating member is in the second posture.

17. The recording apparatus according to claim 15, wherein the tube comprises a plurality of passages to supply a plurality of inks to the recording head, and the joint portion comprises a plurality of joint needles corresponding to the plurality of inks.

18. The recording apparatus according to claim 15, wherein the restoration force is applied to the joint portion such that the manipulating member is urged to maintain the first posture when the joint portion is at the first position.

19. An inkjet recording apparatus comprising:

a carriage configured to mount a recording head for discharging ink;

a joint portion configured to supply the ink to the recording head, the joint portion moving from a first position to a second position along a guide, the joint portion being closer to the recording head at the first position than when the joint portion is at the second position;

a manipulating member configured to rotate about a rotation shaft from a first posture to a second posture with respect to the carriage, the second posture being a posture for attaching the recording head to the carriage and detaching the recording head from the carriage;

a link configured to link the manipulating member to the joint portion such that rotation of the manipulating member from the first posture to the second posture is associated with movement of the joint portion along the guide from the first position to the second position; and a tube configured to supply the ink to the recording head through the joint portion, the tube being connected to the joint portion in a bent state such that a restoration force of the tube, in a direction from the second position toward the first position, is produced and applied to the joint portion, wherein the manipulating member is connected with the link by a first coupling portion, and the link is connected with the joint portion by a second coupling portion, and wherein the first coupling portion is positioned above a line connecting the rotation shaft with the second coupling portion in a vertical direction when the manipulating member is in the second posture.

20. The recording apparatus according to claim 19, wherein the first coupling portion is positioned below the line connecting the rotation shaft with the second coupling portion in the vertical direction when the manipulating member is in the first posture.

* * * * *